US006026881A

United States Patent [19]

Durso

[11] Patent Number: 6,026,881

[45] Date of Patent: Feb. 22, 2000

[54] APPARATUS FOR MONITORING BONDING

[75] Inventor: Scott R. Durso, Moncure, N.C.

[73] Assignee: Lord Corporation, Cary, N.C.

[21] Appl. No.: 08/910,755

[22] Filed: Aug. 13, 1997

[51] Int. Cl.[7] ..... G05G 15/00

[52] U.S. Cl. ..... 156/359; 156/64; 156/382

[58] Field of Search ..... 156/64, 359, 382

[56] References Cited

U.S. PATENT DOCUMENTS

| | | | |
|---|---|---|---|
| 3,573,658 | 4/1971 | Hair et al. | 331/96 |
| 3,888,715 | 6/1975 | Fraser et al. | 156/274.8 |
| 4,352,707 | 10/1982 | Wengler et al. | 156/359 |
| 4,389,438 | 6/1983 | Ohtsuki et al. | 156/277 |
| 4,713,523 | 12/1987 | MacDonald | 156/359 |
| 4,941,936 | 7/1990 | Wilkinson et al. | 156/274.8 |
| 4,941,937 | 7/1990 | Iseler et al. | 156/274.8 |
| 5,064,494 | 11/1991 | Duck et al. | 156/273.5 |
| 5,223,684 | 6/1993 | Li et al. | 156/274.4 |
| 5,277,737 | 1/1994 | Li et al. | 156/274.8 |
| 5,554,252 | 9/1996 | Foran | 156/82 |

OTHER PUBLICATIONS

"Instrumentation Reference and Catalogue, Test and Measurement Industrial Automation 1996", pp. 2–1–246; 3–154–3–172; 3–224–3228; 6–9–6–10, National Instruments Corp. 1995.

*Primary Examiner*—Deborah Jones
*Assistant Examiner*—Robert R. Koehler
*Attorney, Agent, or Firm*—Burns, Doane, Swecker & Mathis, L.L.P.

[57] ABSTRACT

An apparatus for monitoring parts bonded by a bonder such as an RF bonder having tunable electrodes for delivering respective variable amounts of RF energy to respective portions of the bonded part includes a plurality of thermometers, at least one thermometer for each electrode, for measuring respective surface temperatures of the bonded part. The apparatus also includes an electronic digital computer that records and displays effects of tuning the electrodes and circuitry for interfacing the computer to the thermometers. The computer receives and processes temperature measurements generated by the thermometers and information on a dwell time of the bonded part in a nest with no power, the electrodes' temperatures, an ambient temperature, and a geometry of the bonded part, and the computer uses this information to determine the effects of tuning the electrodes.

7 Claims, 4 Drawing Sheets

Robotic Shuttle
26
20

20
25
29
27
22
22
22
22
24

30
Interface Circuitry
36
38
Monitor Display
34
Computer
33
20
32
33
32
33
32
Temperature Sensor
32
33
28
Cooling Nest

APPARATUS FOR MONITORING BONDING

BACKGROUND

Bonding machines are commonly used for curing adhesives that have been deposited between opposing surfaces of two objects, such as two sheets that are to be glued together. These machines have many applications, including the production of automotive body panels and components. This description is written in terms of bonding two sheets together, but it will be appreciated that Applicant's invention is not limited to such use.

Many kinds of bonding machine are currently in use, including heated platen presses, microwave and radio frequency (RF) bonders, hot-air-impingement bonders, ovens, and infrared and other radiative bonders. For example, a heated platen press forces the two sheets and interposed adhesive together between two opposing appropriately shaped platens, and the adhesive is cured by heat conducted from the platens, which may be heated by steam, electricity, hot oil, or hot water. An RF bonder heats the sheets and adhesive, which are disposed between opposing electrodes, usually by some combination of electric current and atomic-scale motion induced by RF energy applied to the electrodes. Such heating by induced motion is analogous to the heating that occurs in a conventional microwave oven. Heating devices are described in many publications, including U.S. Pat. No. 5,223,684 and No. 5,277,737, both to Li et al. and U.S. Pat. No. 5,554,252 to Foran.

The problem with both heated presses and RF bonders is that today's highly engineered adhesives often can be properly cured only by carefully controlling their temperature. Over-heating some adhesives causes degradation and reduced bond strength. Under-heating leaves some adhesives uncured and can preclude the bonded part's compliance with required bond strength and dimensional tolerances. In addition, economical mass production requires each bonded component to be heated quickly for the minimal amount of time. RF bonders are currently more able than are heated presses to meet these requirements. For example, an RF bonder using a frequency of twenty-seven megahertz (27 MHz) at a power on the order of 1–100 kilowatts can need only thirty seconds for curing a large component at 280° F. (138° C.) while a press heated to the same temperature can require several times as long. It will be appreciated that these parameters vary greatly depending on the bonding method and materials used.

Despite their heating speed, current RF bonders have problems in controlling the spatial temperature distribution of large components, such as automotive body panels. The sources of these problems are many. The amount of heat generated is strongly dependent on many process parameters, such as the gap between the electrodes and bonded part as described in U.S. Pat. No. 4,941,937 to Iseler et al. for example. Also, an RF bonder large enough to handle large components includes as many as 16–24 electrodes, each of which may require tuning by adjustment of a respective capacitor. Further, it is desirable to minimize the time needed to complete the production cycle for each component, i.e., the steps of moving the component into the bonder, heating the component, and moving the component out of the bonder in preparation for the next component, but doing so reduces one's control over the bonding process.

One known approach to monitoring an RF bonder involves the use of a thermal imaging system. A thermographic camera captures a continuously updated "picture" of each bonded part after it is shuttled out of the bonder.

Different colors in the "picture" indicate different surface temperatures on the bonded part, and these surface temperatures are used as rough indications of the temperature at the actual bondline, which is usually at some depth beneath the surface. One problem with this system is the camera's view of the part is almost always partially obstructed, preventing measurement of all of the important portions of the part. Another problem with this system is that the indicated temperatures become more and more inaccurate, both absolutely and relatively, as one moves toward the edges of the part. Since adhesives are applied near the edges of many kinds of parts, this kind of thermal imager is most inaccurate in the areas of most interest.

Another known system employs a number of individual infrared thermometers, one aimed at each corner of the bonded part, to determine surface temperatures of parts that have been shuttled out of the bonder. The several surface temperatures determined for each part are displayed on a computer process control screen. This system has problems that are similar to the problems of the system described above. The system gives information on the heating ability of only a few out of many (e.g., four out of sixteen) bonder electrodes.

Besides their other problems, neither of these known systems is accurate enough or suitable for tuning an RF bonder. In this application, the word "tuning" means adjusting so that a desired amount of energy is deposited into an adhesive layer. As mentioned above, an RF bonder large enough to handle large components includes as many as 16–24 electrodes, each of which is tuned by adjusting a respective capacitor. This is depicted in FIG. 1, which shows one view of bonder having sixteen electrodes 1–16 disposed around the edges of a part to be bonded. In a typical bonder, the electrodes receive RF energy distributed through a grid 18 from a single RF source, and an adjustment of one electrode unpredictably changes the tuning of all of the other electrodes. As a result, tuning is currently a tedious process of trial and error, which produces a large number of scrapped parts and long bonder down times, and results are qualitative, requiring interpretation based on experience.

SUMMARY

Applicant's invention improves the current methods and apparatus for monitoring bonders such as multi-electrode RF bonders, reducing the number of scrapped parts and the time needed for tuning. With Applicant's invention, results are quantitative and proper adhesive curing conditions can be ensured. Applicant's apparatus facilitates rapid adjustment, e.g., RF tuning ,of bonders used for bonding SMC exterior automotive body panels, allows an operator to quantify the effect of efforts to adjust or tune a bonder, and greatly reduces the dependence on user-interpreted observational destructive testing techniques. Furthermore, Applicant's monitoring apparatus can be used for temperature mapping, tuning, and to assist quality assurance for any thermal bonding technique, such as hot-air-impingement and heated-platen-press bonding.

In one aspect of Applicant's invention, an apparatus for monitoring a part bonded by a bonder that has delivered a variable amount of energy to respective portions of the bonded part includes a plurality of thermometers, at least one thermometer for each portion, for measuring respective temperatures of the bonded part. The apparatus further includes an electronic computer that records and displays effects of varying the amount of energy delivered and circuitry for interfacing the computer to the thermometers.

The computer receives and processes temperature measurements generated by the thermometers and information on a dwell time of the bonded part in a cooling nest with no power, the bonder's temperature, an ambient temperature, and a geometry of the bonded part; and the computer uses the temperature measurements and information for monitoring the effects of varying the amount of energy delivered by the bonder.

The computer may numerically and graphically display current temperature measurements of a current bonded part and compare a current temperature measurement to a stored temperature measurement of a previous bonded part for monitoring adjustments of the bonder. The computer also may actuate an alarm based on a comparison of a current temperature measurement of a current bonded part and a stored temperature measurement of a previous bonded part.

In another aspect of Applicant's invention, an apparatus for monitoring an RF bonder having a plurality of tunable electrodes for delivering respective variable amounts of RF energy to respective portions of a part to be bonded comprises a plurality of thermometers, at least one thermometer for each electrode, for measuring respective surface temperatures of the bonded part. The apparatus further comprises an electronic digital computer that records and displays effects of tuning the electrodes and circuitry for interfacing the computer to the thermometers.

The computer receives and processes temperature measurements generated by the thermometers, as well as information on a dwell time of the bonded part in a cooling nest with no power, the electrodes' temperatures, an ambient temperature, and a geometry of the bonded part, and the computer uses these measurements and information to determine the effects of tuning the electrodes.

In other aspects of the invention, each thermometer may be attached by a ball-and-socket joint, a mounting bracket, and a tubular extension arm to a robotic shuttle that removes the bonded part from the RF bonder or to a cooling nest into which the shuttle deposits the removed part. The computer may numerically and graphically display current surface temperatures of the bonded part and compare these surface temperatures to surface temperatures of parts previously bonded for tracking the effects of tuning the electrodes.

BRIEF DESCRIPTION OF THE DRAWINGS

The features and objects of Applicant's invention will be understood by reading this description in conjunction with the drawings, in which like elements are identified by like reference numerals and in which.

DETAILED DESCRIPTION

Applicant has recognized that a bonder monitoring and tuning apparatus should perform several main functions. First, the apparatus should measure the temperature at several locations on a bonded part, e.g., at the location of each RF bonder electrode, so that the effects of tuning attempts can be tracked and controlled. Second, the apparatus should include a system for recording and displaying the effects of bonder adjustments, such as RF bonder tuning. Third, the apparatus should include flexible, fast-executing, and user-friendly computer software that processes information on the bonder's operating and environmental conditions. It will be appreciated that although this description is written in terms of RF bonders, the principles of the invention can be applied to the other types of bonders described above.

Figures 2A, 2B, 2C:
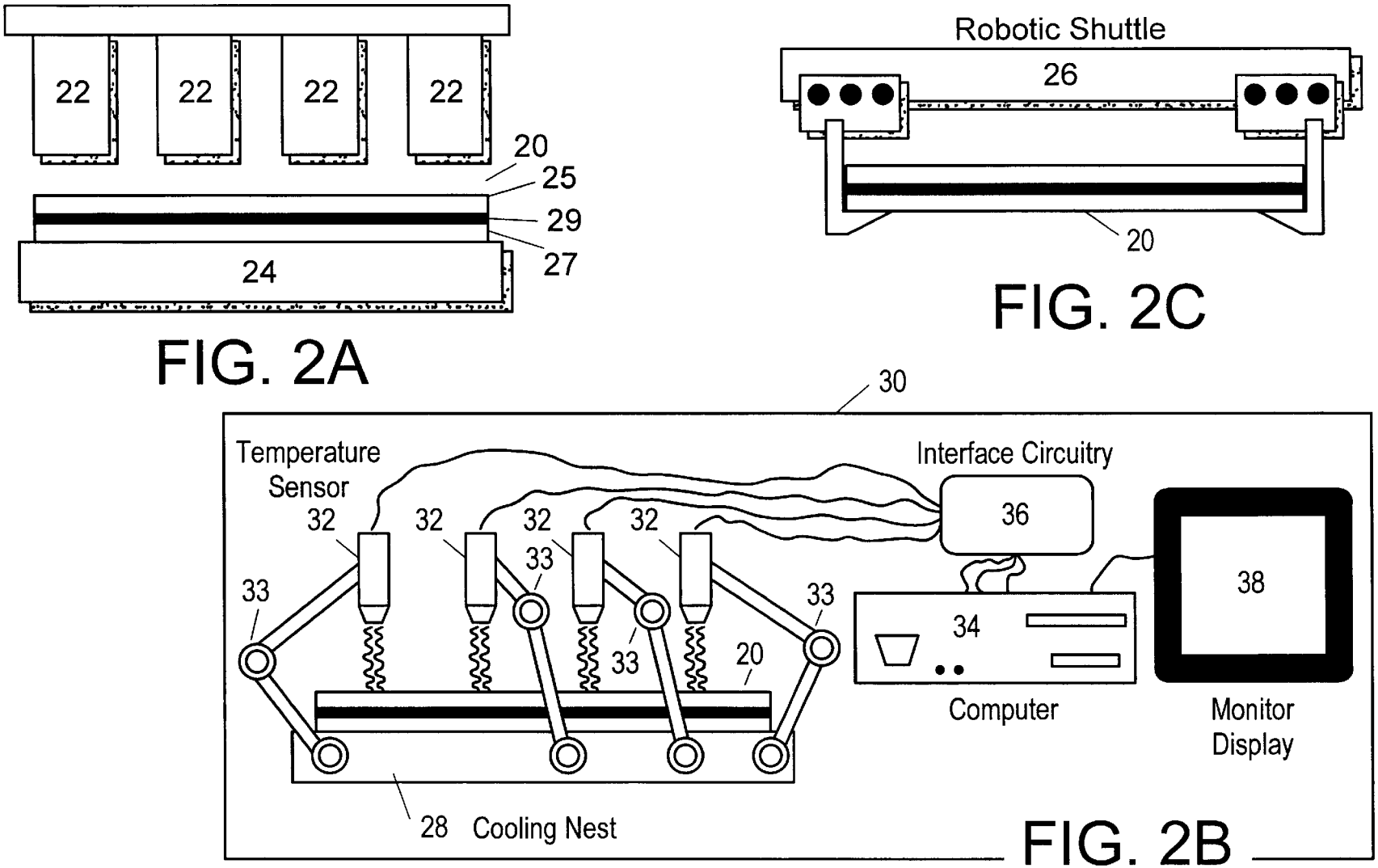
FIGS. 2A, 2B, and 2C illustrate one embodiment of a tuning kit in accordance with Applicant's invention and a portion of an RF bonder.

FIGS. 2A, 2B, and 2C illustrate one embodiment of a monitoring and tuning apparatus 30 in accordance with Applicant's invention and a portion of an RF bonder. As illustrated in FIG. 2A, the portion of the RF bonder comprises a set of electrodes, each of which comprises two opposed electrode elements 22, 24, and a portion of a bonded component 20 that is disposed between the electrode elements. In one application of Applicant's invention, the bonded component 20 may comprise two sheets 25, 27 of SMC polymer that are separated by an adhesive layer 29.

As illustrated in FIG. 2B, the apparatus 30 comprises a group of non-contacting thermometers or temperature sensors 32, one thermometer for each bonder electrode, for measuring the surface temperature of the bonded component 20. Only four thermometers 32 are illustrated in FIG. 2B for clarity. The thermometers are mounted in a convenient fashion with respect to the bonded component. For example, each thermometer may be a model OS65-MV-R7-4-RS4-CC-BB-X7 infrared thermometer made by Omega that may be attached by a ball-and-socket joint, a mounting bracket, and a tubular extension arm (collectively indicated by reference numeral 33) to a robotic shuttle 26 (schematically illustrated in FIG. 2C) that removes the component from the bonder or more preferably to the cooling nest 28 into which the shuttle 26 deposits the removed part. Such attachment hardware 33 facilitates thermometer positioning and portability. The particulars of the robotic shuttle 26 and the cooling nest 28, which is suitably shaped to support uniformly the bonded part, are well known to those of ordinary skill in this art, as indicated for example by the description of nests and bonders in the above-cited U.S. patent to Iseler et al.

The illustrated monitoring and tuning apparatus 30 further comprises an electronic digital computer 34 and suitable circuitry 36 for interfacing the computer 34 to the thermometers 32. The interface circuitry 36 preferably provides signal amplification close to the signal source for increased accuracy, and advantageously is modular for easy expansion and portability. Suitable interface circuitry, including signal multiplexer amplifiers, distributed signal conditioning I/O modules, and computer interface cards, is commercially available from National Instruments, Austin, Tex. The computer 34 receives and processes the temperature measurements generated by the thermometers 32, presenting either the raw or processed information on a suitable control panel and display 38 as described in more detail below. The computer 34 may also receives information on the component's dwell time in the cooling nest with no power, the electrodes' temperatures, the ambient temperature, and the component geometry.

The computer executes software for enabling and coordinating data acquisition and display of the raw and processed information. Such software may be custom-designed, but commercially available software applications may be used instead. For example, the LabVIEW™ 3.1.1 application that is commercially available from National Instruments is suitable. It will be appreciated that it should also be possible for the computer to control the operation of the bonder using this information, provided the hardware and software interfaces between the computer 34 and bonder are appropriately constructed.

Figure 3:
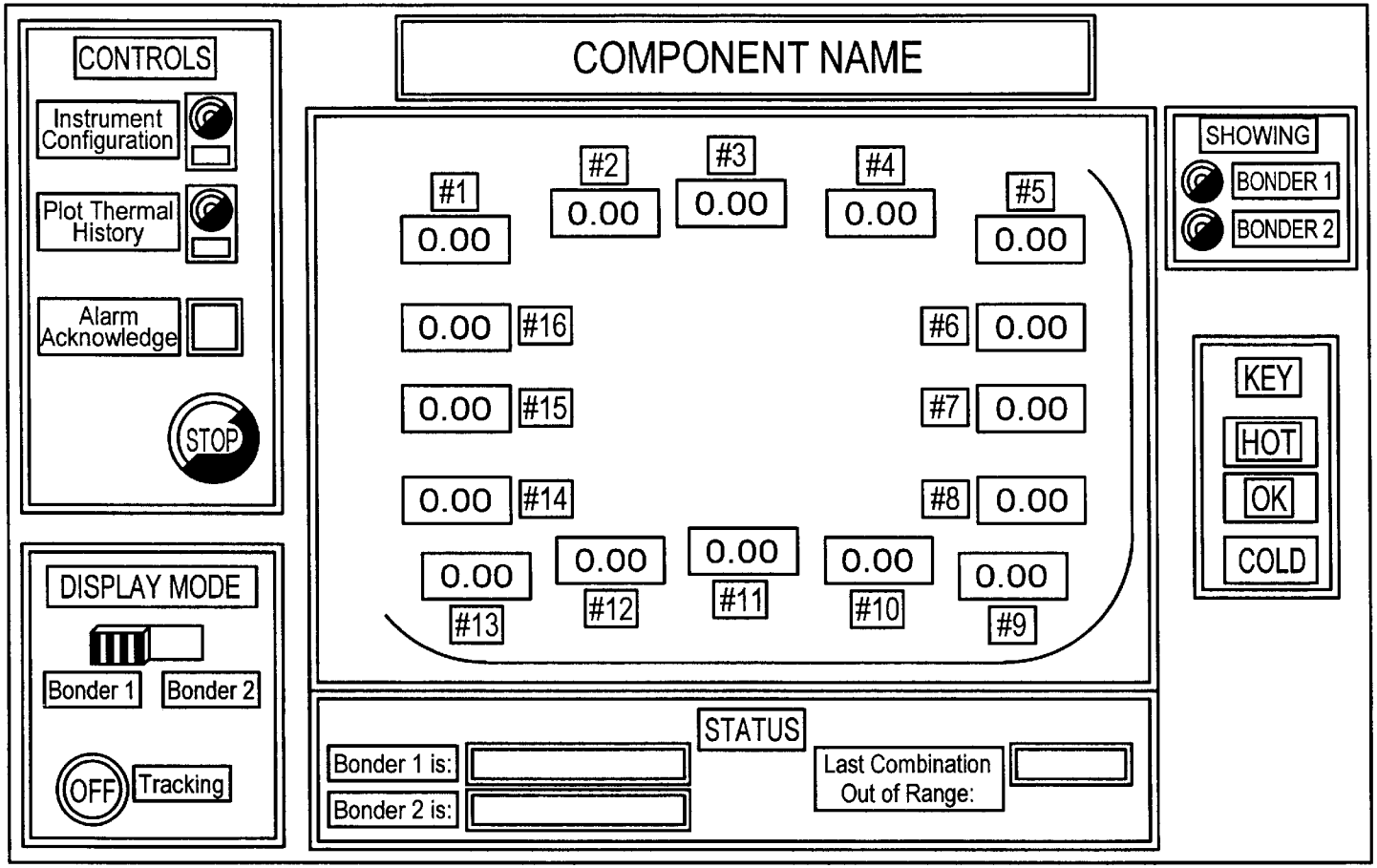
FIG. 3 illustrates the information and format of a display generated by a tuning kit in accordance with Applicant's invention.

The computer 34 numerically and graphically displays the current SMC surface temperature under each electrode at RF power shut off. FIG. 3 is an example of the information and format of such a display. Blocks #1 through #16 show numerical values of the bondline temperatures at respective electrodes 1–16. (The 0.00 values shown in FIG. 3 are simply illustrations.) Advantageously, each block may be colored according to whether the respective temperature is acceptable (e.g., green), too hot (e.g., red), or too cold (e.g., blue). The particular colors and their temperatures may be identified by a suitable key that is also shown on the control panel and display 38.

Since a single conventional desktop-class computer would typically be able to process temperature measurements from a plurality of bonders, it is currently believed to be preferable to switch the display 38 between or among those bonders, thereby maximizing the display area devoted to each. Accordingly, FIG. 3 depicts a bonder display selection switch and indicators for identifying the bonder displayed. Other areas of the display 38 may be devoted to a variety of other status, control, and other information as desired, such as alarms for identifying bonded parts that fail to conform to predetermined specifications. This information is determined by the computer 34 based on the appropriate current and historical temperature measurements. The computer may actuate an alarm based on a comparison of a current temperature measurement of a current bonded part and a stored temperature measurement of a previous bonded part.

Figure 4:
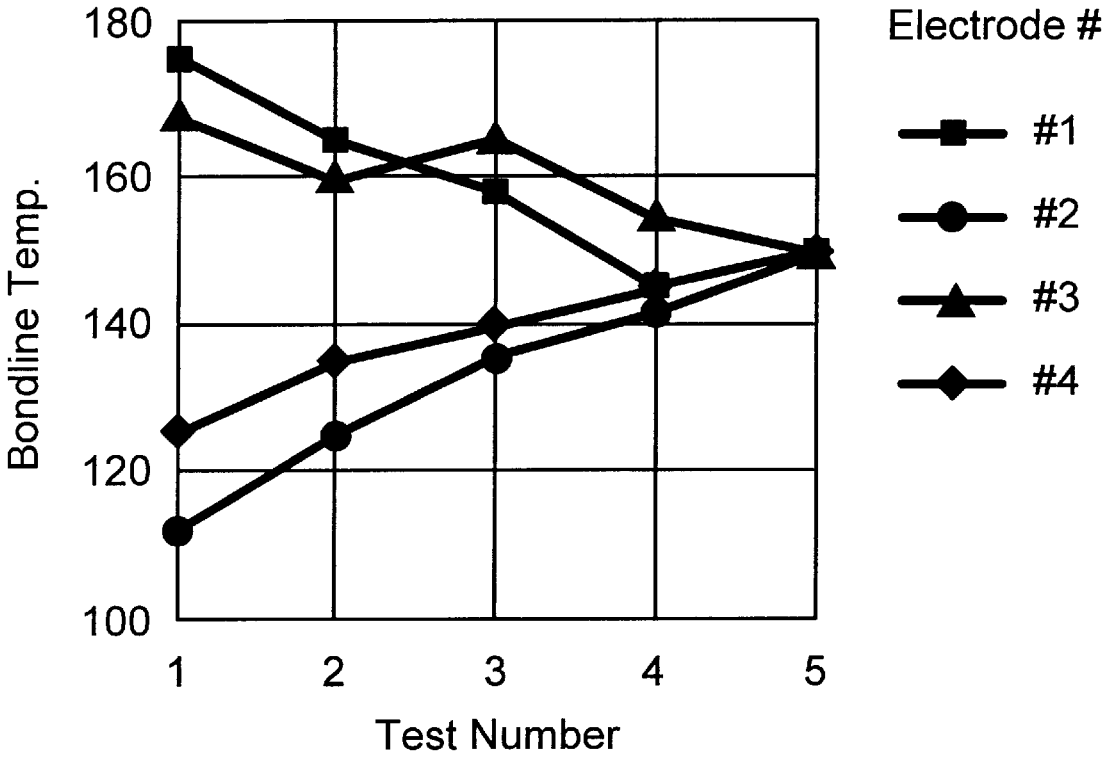
FIG. 4 illustrates a display showing bondline temperatures determined at each of a plurality of electrodes for each of a plurality of test runs.

The current temperature data may also be graphically compared with temperature data obtained from components that have previously been run through the bonder so that the effects of tuning efforts on each electrode can be tracked. The computer 34 can easily be programmed so that it stores such information. An example of such a graphical comparison is shown in FIG. 4, which depicts a snapshot of the computer's display showing bondline temperatures determined at each of four electrodes #1, #2, #3, #4 for five test runs 1, 2, 3, 4, 5. Such a tracking display might be initiated by actuation of a suitable selector device, such as the plot thermal history button illustrated in FIG. 3.

Figure 1:
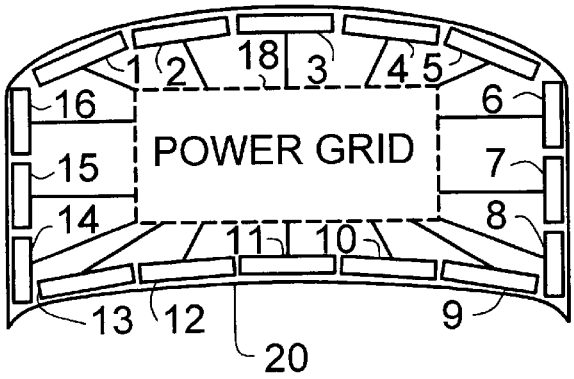
FIG. 1 illustrates an RF bonder having sixteen electrodes disposed around the edges of a bonded part.
Figure 5A:
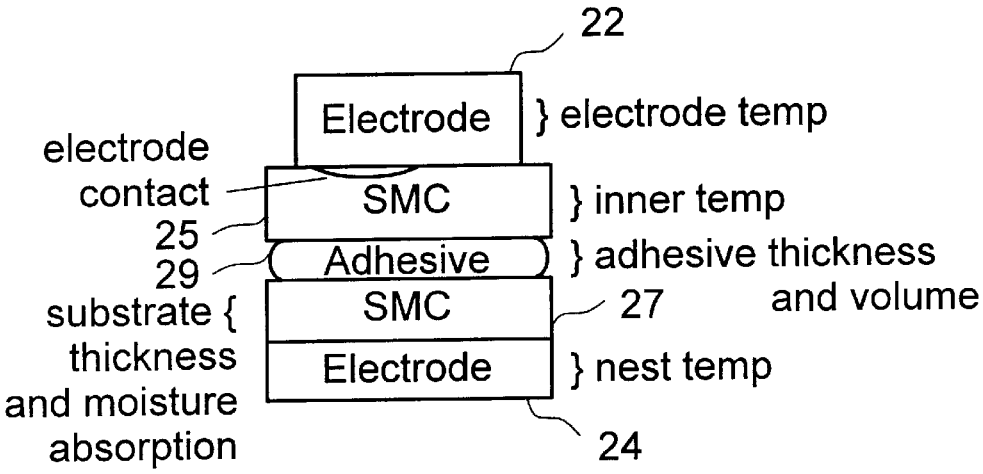
FIG. 5A depicts an idealized cross-section of an RF bonder electrode and a bonded part.
Figure 5B:
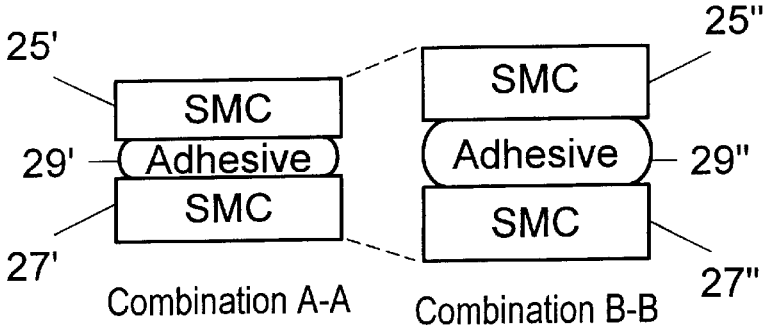
FIG. 5B illustrates geometries of bonded components.

As described above, currently available RF bonders have problems in controlling the spatial temperature distribution of large components because, among other reasons, the amount of heat generated is strongly dependent on many process parameters. This is illustrated by FIG. 5A, which depicts an idealized cross-section of an RF bonder electrode and a bonded part. As described above, the bonded part typically comprises two portions 25, 27 and an interposed adhesive layer 29, and the part is disposed between the elements 22, 24 of the bonder electrode. The bondline temperature is determined not only by the amount of RF energy emitted by the electrode but also by parameters such as the temperatures and thermal conductivities of the electrode elements, the temperatures and thermal conductivities of the polymer portions, and the thickness and volume of the adhesive layer. These latter dimensions of the adhesive relate to the geometry of the bonded component in that, as depicted in FIG. 5B, even nominally identical components 25', 27', 29'; 25", 27", 29" can have different geometries at the same electrode depending on SMC geometry. The electromagnetic absorptions of each of the layers 29 and the exothermic behavior during curing of different adhesives are yet other important parameters.

A bonder monitoring apparatus in accordance with Applicant's invention has several advantages over previous systems. Applicant's determination of the actual bondline temperature under each electrode at the time RF power is shut off is the most valuable information needed for efficiently tuning an RF bonder. The knowledge of bondline temperatures can also be used for optimizing the cure cycle for the adhesive. Furthermore, Applicant's graphical display and tracking of the temperatures makes the effect of tuning efforts immediately and quantitatively apparent.

It will be understood that Applicant's invention is not limited to the particular embodiments described above and that modifications may be made by persons skilled in the art. The scope of Applicant's invention is determined by the following claims, and any and all modifications that fall within that scope are intended to be included therein.

What is claimed is:

1. An apparatus for monitoring a part bonded by a bonder that has delivered a variable amount of energy to respective portions of the bonded part, comprising:

a plurality of thermometers to be used at the respective portions of the bonded part, at least one thermometer for each portion, for measuring respective temperatures of the bonded part;

an electronic computer, wherein the computer records and displays effects of varying the amount of energy delivered; and circuiltry for interfacing the computer to the thermometers;

wherein the computer receives and processes temperature measurements generated by the thermometers and information on a dwell time of the bonded part in a cooling nest with no power, the bonder's temperature, an ambient temperature, and a geometry of the bonded part; and the computer uses the temperature measurements and information for monitoring the effects of varying the amount of energy delivered by the bonder and processes information on the bonder's operating and environmental conditions.

2. The apparatus of claim 1, wherein the computer numerically and graphically displays current temperature measurements of a current bonded part and compares a current temperature measurement to a stored temperature measurement of a previous bonded part for monitoring adjustments of the bonder.

3. The apparatus of claim 1, wherein the computer actuates an alarm based on a comparison of a current temperature measurement of a current bonded part and a stored temperature measurement of a previous bonded part.

4. An apparatus for monitoring a part bonded by a bonder having a plurality of tunable electrodes for delivering variable amounts or RF energy to respective portions of the bonded part, comprising:

a plurality of thermometers to be used at the respective portions of the bonded part, at least one thermometer for each electrode, for measuring respective surface temperatures of the bonded part;

an electronic computer, wherein the computer records and displays effects of tuning the electrodes; and circuitry for interfacing the computer to the thermometers;

wherein the computer receives and processes temperature measurements generated by the thermometers and information on a dwell time of the bonded part in a cooling nest with no power, the electrodes' temperatures, an ambient temperature, and a geometry of the bonded part; and the computer uses the temperature measurements and information for monitoring the effects of tuning the electrodes and processes information on the bonder's operating and environmental conditions.

5. The apparatus of claim 4, wherein each thermometer is attached by a ball-and-socket joint, a mounting bracket, and a tubular extension arm to at least one of a robotic shuttle that removes the bonded part from the RF bonder and places the bonded part on the cooling nest.

6. The apparatus of claim 4, wherein the computer numerically and graphically displays current temperature measurements of a current bonded part and compares a current temperature measurement to a stored temperature measurement of a previous bonded part for tracking the effects of tuning the electrodes.

7. The apparatus of claim 4, wherein the computer actuates an alarm based on a comparison of a current surface temperature measurement of a current bonded part and a stored surface temperature measurement of a previous bonded part.

* * * * *

UNITED STATES PATENT AND TRADEMARK OFFICE

CERTIFICATE OF CORRECTION

PATENT NO. : 6,026,881

DATED : February 22, 2000

INVENTOR(S) : Scott R. DURSO

It is certified that error appears in the above-identified patent and that said Letters Patent is hereby corrected as shown below:

Col. 2, line 33, insert --20-- after the word part, and before the word to.

Signed and Sealed this

Second Day of January, 2001

*Attest:*

*Attesting Officer*

Q. TODD DICKINSON

*Commissioner of Patents and Trademarks*